United States Patent [19]

Coker et al.

[11] 4,049,841

[45] Sept. 20, 1977

[54] SPRAYED CATHODES

[75] Inventors: Thomas G. Coker, Southgate; Shyam D. Argade, Woodhaven, both of Mich.

[73] Assignee: BASF Wyandotte Corporation, Wyandotte, Mich.

[21] Appl. No.: 611,030

[22] Filed: Sept. 8, 1975

[51] Int. Cl.[2] ..... B05D 1/10; B05D 5/12; B05D 7/14

[52] U.S. Cl. ..... 427/34; 427/423

[58] Field of Search ..... 427/34, 423

[56] References Cited

U.S. PATENT DOCUMENTS

| | | | |
|---|---|---|---|
| 2,775,531 | 12/1956 | Montgomery et al. | 427/423 |
| 2,861,900 | 11/1958 | Smith et al. | 427/423 |
| 3,617,358 | 11/1971 | Dittrich | 427/423 |

*Primary Examiner*—James R. Hoffman

*Attorney, Agent, or Firm*—Bernhard R. Swick; Arnold S. Weintraub; Robert E. Dunn

[57] ABSTRACT

A ferrous metal cathode used in a chlor-alkali electrolytic cell has a metallic coating deposited thereon. The metallic coating is applied by either flame spraying or plasma spraying a powdered metal onto the ferrous metal surface. The metals which are utilized are those having a lower hydrogen overvoltage than iron.

9 Claims, No Drawings

SPRAYED CATHODES

BACKGROUND OF THE INVENTION

1. Field of the Invention

The present invention pertains to chlor-alkali cells. More particularly, the present invention concerns cathodes for use in cholor-alkali cells. Even more particularly, the present invention concerns metal coated cathodes for chlor-alkali cells.

2. Prior Art

The electrolytic decomposition of solutions of alkali metal chlorides for the production of chlorine, caustic and hydrogen has long been known. Generally speaking, chlorine gas is generated at the anode; hydrogen gas at the cathode and OH ions (caustic) in the electrolyte. Conventionally, a diaphragm, which is usually secured to the cathode, segregates the anode area from the cathode area. This construction is employed in both conventional monopolar cell arrangments as well as in bipolar filter press cell arrangements.

Typcially, in operating the cells, a voltage of three to four volts is applied thereacross. Although, theoretically, a lower voltage is required to decompose the alkali metal chloride, the higher voltage is utilized because of the resistance of the alkali metal chloride solution and mainly because of the "overvoltage" at the electrodes. This overvoltage results in greater power consumption with the attendant increase in costs of production.

While the prior art has devoted considerable effort in developing improved anodes, the same effort has not been devoted to improving the cathodes. With respect to the cathodes, it has been known that the hydrogen overvoltage at the cathode is a function of the type and surface condition of the cathode material. Therefore, attempts have been made to reduce the hydrogen overvoltage. In U.S. Pat. No. 3,282,808 there is taught the impregnation of a ferrous metal cathode with particles of nickel. However, by embedding the metal into the cathode, hydrogen bubble release is greatly reduced, thereby inhibiting the efficacy thereof.

SUMMARY OF THE INVENTION

In accordance with the present invention, ferrous metal cathodes, such as iron and steel cathodes, which are deployed in electrolytic chlor-alkali cells have applied thereonto a metallic coating. The metallic coating is applied by either flame spraying or plasma spraying a powder metal onto the cathode surface. The metal which is utilized is one having a lower hydrogen overvoltage than the ferrous metal used for the cathode.

In practicing the present invention, the metal is applied to a thickness of from about 0.001 to about 0.006 inches. By spraying the metal powder onto the cathode surface, the surface area is increased due to the unevenness of the sprayed particles.

Useful metal powders for practicing the present invention include cobalt, nickel, platinum, molybdenum, tungsten, manganese, iron, tantalum, niobium, and the like, as well as mixtures thereof. The metals can be admixed with other materials such as graphite or the like. Also, alloys of the metals as well as derivative compounds thereof can be used.

For a more complete understanding of the present invention, reference is made to the following detailed description and accompanying examples.

DESCRIPTION OF THE PREFERRED EMBODIMENTS

As hereinbefore noted, the present invention contemplates the spraying of a powder metal onto a conventional cathode deployed in an electrolytic chlor-alkali cell. The powder metal is either flame sprayed or plasma sprayed onto the cathode.

With more particularity, the present invention contemplates the spraying of a powder metal onto a ferrous metal cathode utilized in an electrolytic chlor-alkali cell. The chlor-alkali cell can be either a monopolar or bipolar cell. Furthermore, the cell can employ either an asbestos-deposited diaphragm or a synthetic polymeric diaphragm such as those manufactured from perfluorinated polymers, chloro-substituted perfluorinated polymers, sulfonated polymers and the like. Also, the present invention is useful in chlor-alkali membrane electrolytic cells.

As noted, the powder metal is either flame sprayed onto the cathode or plasma sprayed onto the cathode. The spraying of the metal onto the cathode surface provides a high degree of bonding while increasing the surface area of the cathode. Furthermore, by spraying the coating onto the surface, the resulting roughened surface provides the proper conditions for efficient hydrogen bubble release. This is to be contrasted with the prior art noted hereinbefore which did not enhance the efficiency of the hydrogen bubble release.

Flame spraying and plasma spraying techniques, per se, are known. Flame spraying generally comprises spraying and fusing a powder metal onto a metallic surface with a flame. Such flames are generated with a torch or similar apparatus. Such apparatus and techniques are more comprehensively discussed in U.S. Pat. Nos. 3,238,060; 2,786,779 and 3,220,068.

Plasma spraying generally comprises the utilization of an electric arc discharge through which a plasma gas is passed. As the gas passes the electric arc the gas is ionized. Thus, there is achieved a plasma of ionized gas. There is admixed with the plasma of ionized gas, a powder metal suspended in a carrier gas. Thus, issuing from the arc is the ionized plasma admixed with the powder metal which is suspended in the carrier gas therefor. Usually, a plasma spray gun is utilized for the plasma spray coating. Such guns are known. One such gun is depicted in U.S. Pat. No. 3,630,770.

In practicing the present invention, it is preferred to plasma spray coat the cathode. Plasma spraying provides a higher temperature than flame spraying and results in a greater degree of bonding than flame spraying. The gases employed in plasma spraying are nitrogen and hydrogen, wherein hydrogen gas is ionized and the powder metal is suspended in the nitrogen.

The powder metals which can effectively be employed herein are those which have a lower hydrogen overvoltage than the ferrous metal used in manufacturing the cathode. Representative of the metals which can be used herein include, for example, cobalt, nickel, platinum, molybdenum, tungsten, manganese, iron, tantalum, niobium and mixtures thereof. In addition, alloys of these metals can be used. Also, metallic compounds such as carbides, nitrides and the like can be used such as tungsten carbide, iron nitride and the like. The pure metals can be used alone or can be admixed with the alloys and the compounds. Also, the alloys and the metallic compounds can be used alone. The only criteria attached to the metal are that it be a powder capable of being sprayed and have a lower hydrogen overvoltage than the cathode material. In the practice of the present invention, the preferred powder metal is nickel.

The metal is sprayed onto the cathode to a thickness of about 0.001 to about 0.006 inches. Preferably, the metal is deposited to a thickness of from about 0.002 to about 0.005 inches.

By the practice of the present invention, it has been found that while the current supplied to the cathode can be increased there is no equal proportional rise in the volage thereat, i.e. a reduction in the overvoltage.

For a more complete understanding of the present invention, reference is made to the following examples. In the examples, which are to be construed as illustrative, rather than limitative of the invention, all of the cathodes were formed from a mild steel base material.

EXAMPLE I

A series of three steel cathodes were plasma sprayed with a nickel powder sold commercially under the name METCO XP-1104. Thereafter, a series of three cathodes were plasma sprayed with a tungsten carbide powder containing twelve percent cobalt powder and sold under the name METCO 72F-NS tungsten carbide-12% cobalt powder.

The so-sprayed steel cathodes were then installed in a twenty cell module asbestos disphragm bipolar electrolytic chlor-alkali filter press cell. Also installed in the cell were uncoated steel cathodes. A brine feed was introduced into the module and electrolysis was carried out. The module was operated at a constant cell current of two hundred amps per square foot. The voltage at each of the cathodes was measured and compared to the calomel electrode, as the reference electrode. The following table, Table I, sets forth the results of these tests. In the table, the notations (WC) and (Ni) indicate coated cathodes of the tungsten carbide and nickel, respectively.

TABLE I

CATHODE VOLTAGE vs. CALOMEL VOLTAGE

| Cell Number | Day of Test Run 4 | 5 | 6 | 7 |
|---|---|---|---|---|
| 1 (WC) | — | 1.29 | 1.23(−0.17) | 1.28(−0.07) |
| 2 (Ni) | — | 1.34 | 1.30(−0.10) | 1.30(−0.05) |
| 3 (Ni) | — | — | 1.32(−0.08) | 1.26(−0.09) |
| 4 (Ni) | 1.32(−0.08)[1] | — | 1.24(−0.16) | 1.28(−0.07) |
| 5 (WC) | 1.32(−0.08) | — | 1.27(−0.13) | 1.27(−0.08) |
| 6 (WC) | 1.32(−0.08) | — | 1.35(−0.15) | 1.29(−0.06) |
| 7 | 1.40 | — | 1.40 | 1.36 |
| 8 | 1.39 | — | 1.39 | 1.33 |

[1]the difference between the coated and uncoated cathode potentials.

From the above data it is seen that each cell operated at a lower hydrogen overvoltage when using a sprayed cathode in lieu of an unsprayed cathode. Furthermore, at each cell there was an average drop of 0.1 volts when the spray coated cathode was used in lieu of an unsprayed cathode.

EXAMPLE II

The procedure of Example I was repeated. In this example the cells were run for a thirty day period. At a constant cell current of two hundred amps per square foot there was an average voltage reduction at each cell on an average of between 0.05 volts and 0.10 volts, over the thirty day period where a coated cathode was employed.

EXAMPLE III

The procedure of Example I was repeated. However, in conducting this example, each cell was run at a reduced current of one hundred and fifty amps per square foot. After fifty days it was observed that each cell having a coated cathode operated at an average reduced voltage of 0.05 volts over the fifty day period as compared to an uncoated cathode.

EXAMPLE IV

A mild steel cathode was plasma spray coated with a powder nickel to a thickness of about 0.002 inches. The powder nickel employed was that sold commercially under the name METCO Nickel Powder 56N-FS. An asbestos diaphragm was deposited onto the cathode by conventional techniques. The cathode was then installed in a monopolar Diamond Chlorine Cell. After intallation, the cell was then run in a cell room in conjunction with over three hundred other cells, but which did not have coated cathodes. After nine days, and at a current density of about 109 ASF, the cell containing the coated cathode evidenced a voltage of 3.05 volts. The other cells had a mean cell voltage of 3.21 volts. Thus, there was provided a 0.16 volt voltage reduction.

After twenty-six days, and at a current density of 116 ASF, the cell containing the coated cathode evidenced a voltage of 3.09 volts. The mean cell voltage was 3.29 volts. Thus, there was a 0.20 volt voltage reduction for the cell having the coated cathode at a current density of 116 ASF.

EXAMPLE V

The procedure of Example IV was repeated, wherein the nickel was sprayed onto the cathode at a thickness of about two thousandths of an inch.

After the asbestos was deposited on the cathode, the cathode was installed in a monopolar Hooker Chlorine Cell. The cell room contained about four hundred cells with uncoated cathodes.

After operating the cell room for twelve days at a current density of about 115 ASF, the cell containing the coated cathode evidenced a voltage of 3.11 volts. The average of eight other cells, without the coated cathode, in the cell room was 3.26 volts.

Thus, the efficacy of the present invention in monopolar cells is established.

Having, thus, described the invention, what is claimed is:

1. In a method for manufacturing a chlor-alkali electrolytic cell wherein the cathode is prepared by coating a ferrous metal substrate with a metal, the improvement comprising:

spray coating the ferrous metal substrate with a powder metal to bond the powder metal to the substrate the powder metal having a lower hydrogen overvoltage than the substrate, the powder metal increasing the surface area of the cathode while maintaining efficient hydrogen bubble release.

2. The improvement of claim 1 wherein the substrate is spray coated by flame spraying the powder metal onto the substrate.

3. The improvement of claim 1 wherein the substrate is spray coated by plasma spraying the powder metal onto the substrate.

4. The improvement of claim 1 wherein the powder metal is selected from the group consisting of cobalt, nickel, platinum, molybdenum, tungsten, manganese, iron, tantalum, niobium, carbides thereof, nitrides thereof, aluminides thereof, alloys thereof and mixtures thereof.

5. The improvement of claim 4 wherein the powder metal is selected from the group consisting of nickel, cobalt, tungsten carbide and mixtures thereof.

6. The improvement of claim 1 wherein the coating has a thickness of from about 0.001 to about 0.006 inches.

7. In a method for manufacturing a chlor-alkali electrolytic cell wherein the cathode is prepared by coating a ferrous metal substrate with a metal, the improvement comprising:

flame spraying the ferrous metal substrate with a powder metal to bond the powder metal to the substrate, the powder metal having a lower hydrogen overvoltage than the substrate, the powder metal increasing the surface area of the cathode while maintaining efficient hydrogen bubble release.

8. In a method for manufacturing a chlor-alkali electrolytic cell wherein the cathode is prepared by coating a ferrous metal substrate with a metal, the improvement comprising:

plasma spraying the ferrous metal substrate with a powder metal to bond the powder metal to the substrate, the powder metal having a lower hydrogen overvoltage than the substrate, the powder metal increasing the surface area of the cathode while maintaining efficient hydrogen bubble release.

9. In a method for manufacturing a chlor-alkali electrolytic cell wherein the cathode is prepared by coating a ferrous metal substrate with a metal, the improvement comprising:

spray coating onto the ferrous metal substrate a powder metal to bond the powder metal, the powder metal having a lower hydrogen overvoltage than the substrate, the coating having a thickness ranging from about 0.001 to about 0.006 inches, the powder metal increasing the surface area of the cathode while maintaining efficient hydrogen bubble release.

* * * * *